US005558056A

United States Patent [19]

Sakata

[11] Patent Number: 5,558,056

[45] Date of Patent: Sep. 24, 1996

[54] TWO-PIECE VALVE STEM SEAL

[75] Inventor: David Sakata, Livonia, Mich.

[73] Assignee: Freudenberg-NOK General Partnership, Plymouth, Mich.

[21] Appl. No.: 557,459

[22] Filed: Nov. 14, 1995

[51] Int. Cl.[6] ..... F01L 3/08

[52] U.S. Cl. ..... 123/188.6

[58] Field of Search ..... 123/188.6, 188.13; 277/102, 164

[56] References Cited

U.S. PATENT DOCUMENTS

| | | | |
|---|---|---|---|
| 2,157,865 | 7/1939 | Robertson et al. . | |
| 2,207,400 | 7/1940 | Gass . | |
| 2,418,674 | 4/1947 | Steiner . | |
| 3,162,185 | 12/1964 | Knoblock . | |
| 3,306,621 | 2/1967 | Fisher . | |
| 3,554,180 | 1/1971 | Lesser . | |
| 3,554,182 | 1/1971 | Whitacre . | |
| 3,554,562 | 1/1971 | Davis, Jr. . | |
| 4,798,181 | 1/1989 | Beer et al. . | |
| 4,822,061 | 4/1989 | Kammeraad | 123/188.6 |
| 4,909,202 | 3/1990 | Binford et al. . | |
| 4,919,090 | 4/1990 | Deuring et al. | 123/188.6 |
| 4,947,811 | 8/1990 | Binford . | |

FOREIGN PATENT DOCUMENTS

| | | | |
|---|---|---|---|
| 0021874 | 5/1980 | European Pat. Off. . | |
| 173510 | 10/1984 | Japan | 123/188.6 |

*Primary Examiner*—Erick R. Solis
*Attorney, Agent, or Firm*—Dinnin & Dunn, P.C.

[57] ABSTRACT

An improved valve stem seal assembly for use in an internal combustion engine, including a rigid cylindrical shell having a flange portion and a seal retainer wall at the top portion. The valve stem seal assembly also includes a seal body having an integral spring molded within the body. The seal body having at least one annular lip to engage a reciprocating valve stem and a ridge or lip on the bottom portion of the seal body to engage and center the seal body in its proper position on the valve guide. The seal body being disposed within the rigid shell to form a valve stem seal assembly.

21 Claims, 1 Drawing Sheet

TWO-PIECE VALVE STEM SEAL

BACKGROUND OF THE INVENTION

1. Field of the Invention

The present invention relates to valve stem seals, and more particularly to a two-piece valve stem seal for use in intake and exhaust manifolds of an internal combustion engine.

2. Description of Related Art

Valve stem seals are known in the art as shown in U.S. Pat. Nos. 4,947,811; 4,909,202; 3,554,562; and 3,554,180. The valve stem seals are used to keep oil from being drawn into the combustion chamber or into the exhaust manifold from around the valve stem. If leakage is allowed to occur an increase in oil consumption of the vehicle and an impairment of proper engine performance as specified by manufacturers will result.

Generally speaking a valve stem seal assembly includes a rigid shell to secure a seal body on a valve stem guide, with the inside diameter of the shell engaging the outside diameter of the guide. The shell usually supports a sealing element which is centered about the valve stem in order to meter the oil that lubricates the guide inner diameter valve stem interface yet limit oil or liquid from being drawn into a combustion chamber or exhaust chamber. If the rigid shell is not properly placed in relation to the valve guide the sealing element might not properly seat upon the valve stem thus causing non-uniform pressures at the cylinder and valve guide, undesirable wear patterns on the seal or valve stem and unpredictable oil control for the valve stem.

U.S. Pat. No. 4,947,811 uses a garter spring to secure the rubberized seal member around the valve stem. This design is insufficient because the garter spring can dislodge or pop off during installation or over usage. With the spring missing there is no longer compression force on the valve stem thus reducing the effectiveness of the seal. The use of this garter spring also increases the weight and production costs of such a valve guide system.

Other designs of current valve stem seals are disadvantaged by the high assembly load used in metal-to-metal press fittings. This increases the cost of assembling the valve guide system.

Therefore, there is a need in the art for a valve stem seal to overcome the many disadvantages of the prior art.

SUMMARY OF THE INVENTION

One object of the present invention is to provide an improved two-piece valve stem seal.

Another object of the present invention is to provide a valve stem seal which reduces the space, weight, and costs of manufacturing such a seal.

To achieve the foregoing objects the improved valve stem seal includes an elastomeric seal body within a rigid cylindrical shell. The elastomeric seal body includes an integral finger spring. The rigid cylindrical shell includes an extending end wall which is in contact with a valve spring. The rigid cylindrical shell includes a plurality of finger-like appendages which reduces the amount of material necessary to create the rigid cylindrical shell. The inner diameter of the elastomeric seal body is slightly less the than the diameter of the valve stem in order to generate the desired fluid sealing and metering of the oil. The elastomeric seal body engages the valve stem with a single annular lip.

One advantage of the present invention is that it reduces the height of the valve stem seal which allows the valve train height to be reduced. This will create savings in the space and weight necessary to create a valve train.

Another advantage of the present invention is that it eliminates spring pop-off during assembly onto the internal combustion engine while maintaining a controlled load over the life of the valve seal.

A further advantage of the present invention is the reduction of manufacturing costs by reducing the volume of rubber needed to create the valve seal assembly.

Yet another advantage of the present invention is that the valve stem seal is securely fastened to the valve guide outer diameter without the need for excessive assembly loads.

Other objects, features and advantages of the present invention will become apparent from the subsequent description and appended claims taken in conjunction with the accompanying drawings.

Figure 1:
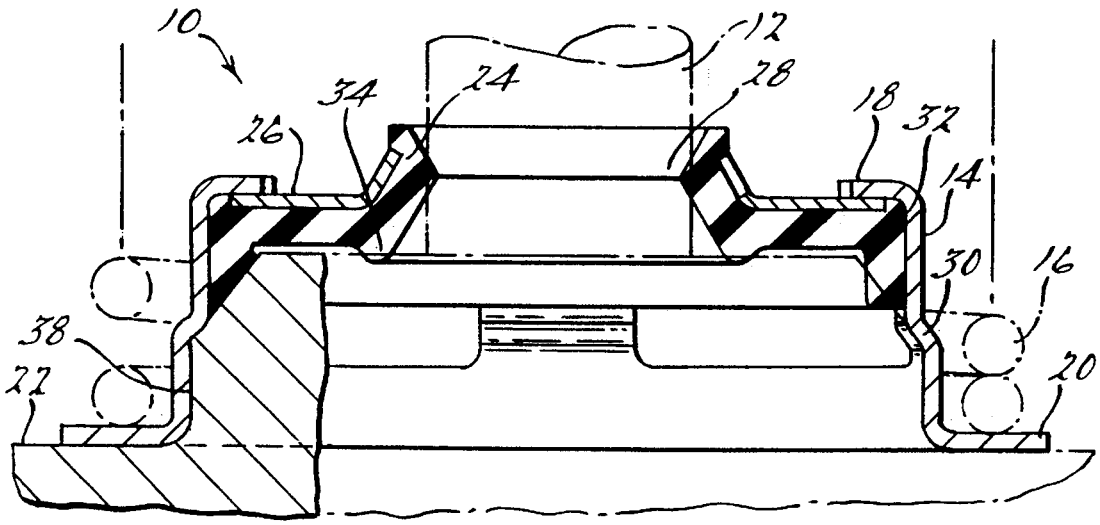
FIG. 1 shows a plan view of the present invention.
Figure 2:
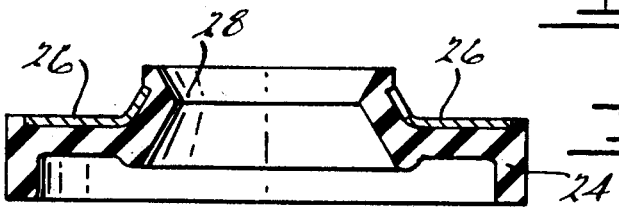
FIG. 2 shows a cross-section of the seal assembly.
Figure 3:
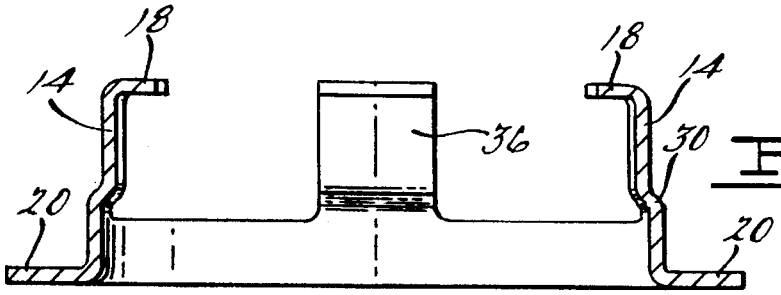
FIG. 3 shows a cross-section of the rigid outer shell.
Figure 4:
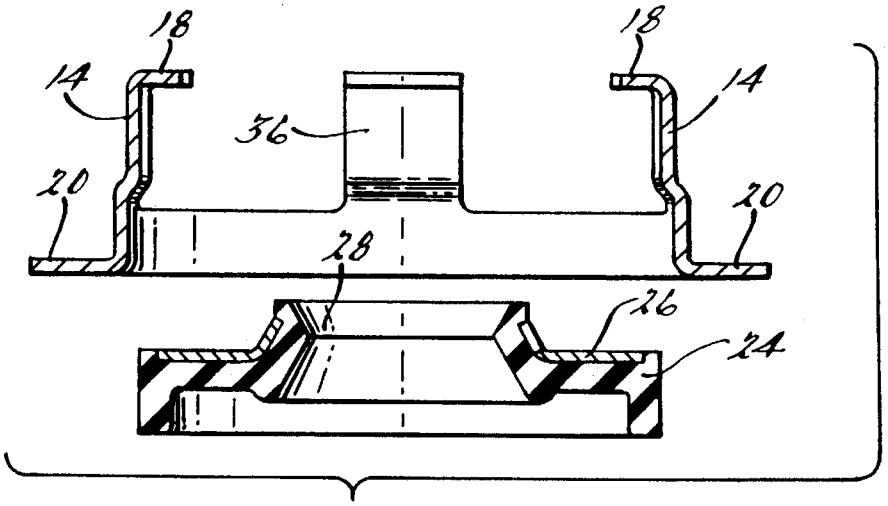
FIG. 4 shows the seal assembly just prior to insertion within the outer shell.

BEST MODE IN CARRYING OUT THE INVENTION AND DESCRIPTION OF THE PREFERRED EMBODIMENT(S)

Referring to the drawings, a valve stem seal assembly 10 includes a rigid metal cylindrical casing or shell 14. It should be noted that the cylindrical shell may also be made of a composite material or hard plastic. The assembly also includes a resilient seal body 24 formed of a rubber or an elastomeric-type product. The seal body 24 includes an angular lip 28 which engages a valve stem 12. The valve stem 12 is placed within a valve guide 38. The valve stem 12 has a reciprocating motion within the valve guide 38.

The rigid cylindrical shell 14 includes a radially extending flange 20 at the bottom of the shell 14, the flange 20 is in contact with the valve spring 16. The rigid cylindrical shell 14 also includes a radially extending end wall 18 at the top of the shell 14 which engages the seal body 24. The cylindrical shell 14 also includes an outwardly extending ridge 30. The flange 20 at the bottom of the cylindrical shell 14 acts as a seat for the valve spring 16. The engine head assembly 22 upon which the flange 20 of the rigid cylindrical shell 14 rests is usually aluminum. It should be noted that other materials may also be used for the engine head, such as composites, cast iron, steel or other metals.

The rigid cylindrical shell 14 includes finger like appendages or projections 36 around its entire periphery. This reduces the amount of metal used in the cylindrical shell 14. The inner diameter below ridge 30 of the shell 14 is designed to be approximately one to three ten thousands of an inch smaller than the outer diameter of the valve guide 38 about which the cylindrical shell 14 is placed, this interference fit may vary depending on the materials used. This creates a press fit joint and securely fastens the cylindrical shell 14 upon the valve guide 38 without need of further fastening devices. The metal to metal press fit is the preferred way to fasten the cylindrical shell 14 to the valve guide 38 but other methods may also be used such as welding or bonding agents.

The seal body 24 includes a rubber or elastomer member 32 which is used to seal the valve stem 12. The seal body 24 also includes an annular lip 28 which is used to make the seal area about the valve stem 12. The seal body rubber member 32 includes a circumferential ridge or lip 34 on its bottom portion for use in seating the seal body 24 on top of the valve guide 38. The ridge 34 allows the seal body 24 to interact with the contour of the top of the valve guide in order to have a complete seal about the valve guide 38.

Within the top portion of the seal body 24 is inserted a circumferential finger-like integral spring 26. In the preferred embodiment the spring 26 is made of a plastic material. However, it should be noted that a steel material or other type of metal may also be used to make the spring. The finger spring 26 is formed just before molding of the rubber seal body 24 to reduce and minimize any handling difficulties. The spring 26 is used to keep the annular lip 28 in constant contact with the valve stem 12. The finger spring 26 has a generally L-shaped cross-section and is molded within the seal body 24 such that it is either partially or completely within the outer rubber portion of the seal body 24. With the spring integral to the seal body 24 there is no longer the worry of spring pop-off during assembly of the valve system.

During assembly of the valve stem seal assembly 10 the rubber seal body 24 is placed within the rigid cylindrical shell 14, such that the spring 26 is in contact with the end wall 18 of the cylindrical shell 14. The outer diameter of the seal body 24 is approximately two to three ten thousands of an inch greater than the inner diameter of the top portion of the cylindrical shell 14. Making the outer diameter of the seal body 24 larger allows for a press fit assembly of the two parts. Other methods may also be used to connect the cylindrical shell 14 to the seal body 24 such as bonding agents. The press fit in the present invention is a rubber to metal press fit. This also creates correct alignment of the seal body 24 within the cylindrical shell 14 and in relation to the valve guide 38 and valve stem 12. If the seal body 24 is not centered correctly upon the valve guide 38 it may cause oil leakage at the valve seal body 24 and may also reduce the lifetime of the valve seal.

After the seal body 24 is secure within the cylindrical shell 14, the entire cylindrical shell 14 and seal body 24 are placed upon the valve guide 38. The internal contour of the cylindrical shell 24 is slightly smaller than the outer contour of the valve guide 38 and thus a press fit is a accomplished between the valve guide 38 and the cylindrical shell 14 to allow for a secure fit. Once the press fit is accomplished between the cylindrical shell 14 and the valve guide 38, the valve spring 16 is placed around the cylindrical shell 14 and the valve stem 12 is placed through the valve guide 38. This creates a complete oil seal assembly that allows controlled metering of oil to the guide inner diameter valve stem interface.

Other methods may be used to secure the cylindrical shell 14 and seal body 24 to the valve guide 38. Spot welding, laser welding and any other type of bonding may be used.

The present invention has been described in an illustrative manner, it is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise then as specifically described.

What is claimed:

1. A valve stem seal assembly for use in an internal combustion engine, said assembly including:

a rigid shell having a radially outwardly extending flange at a bottom end of said shell and a radially inwardly extending end wall at a top end of said shell, said flange contacting a valve spring;

a resilient body placed and secured within said rigid shell, said body being press fitted within said rigid shell; and a finger spring molded in a top portion of said resilient body.

2. The valve stem seal assembly of claim 1 wherein said resilient body includes at least one annular lip.

3. The valve stem seal assembly of claim 1 wherein said resilient body further includes a ridge on a bottom portion of said body, said ridge engaging with a top end of a valve guide.

4. The valve stem seal assembly of claim 1 wherein said resilient body further includes a lip on a bottom surface of said body.

5. The valve stem seal assembly of claim 1 wherein said rigid shell includes finger-like projections descending from a top edge of said rigid shell.

6. The valve stem seal assembly of claim 5 wherein said finger-like projections correspond to an outer shape of a valve guide.

7. The valve stem seal assembly of claim 1 wherein said rigid shell is made of a steel or plastic material.

8. The valve stem seal assembly of claim 1 wherein said spring is made of a plastic or steel material.

9. The valve stem seal assembly of claim 1 wherein said spring is molded within said resilient body prior to being disposed within said rigid shell.

10. A valve stem seal assembly for use with a reciprocating valve within an internal combustion engine, said assembly including:

a rigid cylindrical shell having a radially outwardly extending flange at a bottom end of said shell, said shell having a radially inwardly extending seal retainer wall at a top end of said shell;

a resilient seal body having a ring like shape, said body located within said shell in contact with said end wall and said shell, said body having a circumferential ridge on a bottom end of said body, said body in contact with a valve guide, said body having an annular lip which is in a continuous sealing engagement with a valve stem; and an integral circumferential spring molded in a top portion of said body.

11. The valve stem seal assembly of claim 10 wherein said shell is press fitted upon said valve guide.

12. The valve stem seal assembly of claim 11 wherein said flange is in contact with a valve spring.

13. The valve stem seal assembly of claim 10 wherein said shell includes an outwardly extending ridge.

14. The valve stem seal assembly of claim 10 wherein said spring is metal.

15. The valve stem seal assembly of claim 10 wherein said spring is plastic.

16. The valve stem seal assembly of claim 10 wherein said shell is steel or plastic.

17. A valve stem seal assembly for use in an internal combustion engine, said assembly including:

a rigid shell having a radially inwardly extending end wall at a top end of said shell;

a resilient seal body placed and secured within said rigid shell; and a finger spring in contact with a top portion of said resilient body.

18. The valve stem seal assembly of claim 17 wherein said finger spring has a generally L-shaped cross-section.

19. The valve stem seal assembly of claim 17 wherein said rigid shell includes a radially outwardly extending flange at a bottom end of said shell, said flange in contact with a valve spring.

20. The valve stem seal assembly of claim 17 wherein said body is press fitted within said rigid shell.

21. The valve stem seal assembly of claim 17 wherein said finger spring is molded in said top portion of said resilient body.

* * * * *